US006238548B1

(12) United States Patent
Upson et al.

(10) Patent No.: US 6,238,548 B1
(45) Date of Patent: May 29, 2001

(54) FCC PROCESS FOR UPGRADING GASOLINE HEART CUT

(75) Inventors: Lawrence L. Upson, Barrington; Julie E. Wesling, Des Plaines, both of IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/388,978

(22) Filed: Sep. 2, 1999

(51) Int. Cl.[7] ..... C10G 57/00

(52) U.S. Cl. ..... 208/67; 208/69; 208/70; 208/113

(58) Field of Search ..... 208/67, 69, 70, 208/113

(56) References Cited

U.S. PATENT DOCUMENTS

| | | | |
|---|---|---|---|
| 2,921,014 | 1/1960 | Marshall | 208/74 |
| 2,956,003 | 10/1960 | Marshall et al. | 208/74 |
| 3,161,582 | 12/1964 | Wickham | 208/74 |
| 3,607,129 | 9/1971 | Carson | 23/288 S |
| 3,776,838 | 12/1973 | Youngblood et al. | 208/74 |
| 3,847,793 | 11/1974 | Schwartz et al. | 208/70 |
| 4,032,432 | 6/1977 | Owen | 208/70 |
| 4,176,049 * | 11/1979 | Winter et al. | 208/70 |
| 4,865,718 * | 9/1989 | Herbst et al. | 208/70 |
| 5,154,818 | 10/1992 | Harandi et al. | 208/74 |
| 5,176,815 | 1/1993 | Lomas | 208/78 |
| 5,310,477 | 5/1994 | Lomas | 208/78 |
| 5,372,704 | 12/1994 | Harandi et al. | 208/74 |
| 5,702,589 * | 12/1997 | Tsang et al. | 208/67 |

* cited by examiner

*Primary Examiner*—Walter D. Griffin
(74) *Attorney, Agent, or Firm*—John G. Tolomei; James C. Paschall

(57) ABSTRACT

An FCC process converts a secondary feed comprising a heart cut of a gasoline product stream with spent catalyst at mild conditions to obtain a surprising increase in the octane number of the resulting gasoline product. More surprisingly, the increase in gasoline stream octane number occurs with very low production of dry gas. Limiting the presence of heavy gasoline components was found to significantly raise the octane number produced by the process.

26 Claims, 1 Drawing Sheet

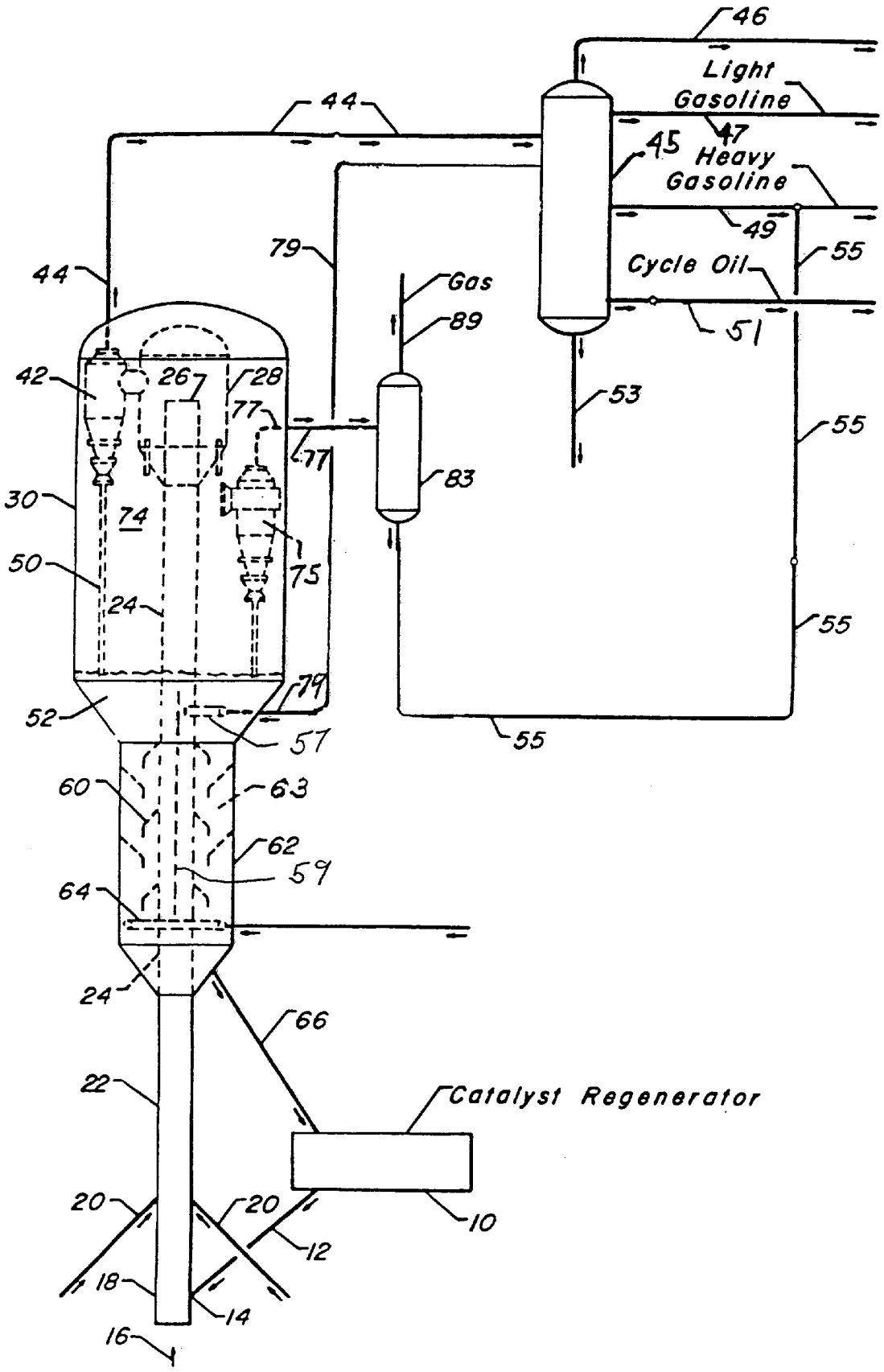
46
Light Gasoline
44
47
45
Heavy Gasoline
49
55
Cycle Oil
51
79
Gas
89
44
42
26
28
77
53
55
77
83
30
74
50
75
24
55
79
52
57
55
60
63
62
59
64
24
66
22
Catalyst Regenerator
20
20
10
12
18
14
16

FCC PROCESS FOR UPGRADING GASOLINE HEART CUT

FIELD OF THE INVENTION

This invention relates generally to processes for the fluidized catalytic cracking (FCC) of heavy hydrocarbon streams such as vacuum gas oil and reduced crudes. This invention relates more specifically to a method for separately reacting a traditional FCC feedstream and a gasoline feed in an FCC reaction zone.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator, and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by countercurrent contact with steam or another stripping medium.

The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. The cracking reaction deposits coke on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The FCC unit cracks gas oil or heavier feeds into a broad range of products. Cracked vapors from the FCC reactor enter a separation zone, typically in the form of a main column, that provides a gas stream, a gasoline cut, cycle oil and heavy residual components. The gasoline cut includes both light and heavy gasoline components. A major component of the heavy gasoline fraction comprises heavy single ring aromatics.

DISCLOSURE STATEMENT

U.S. Pat. No. 3,161,582 and U.S. Pat. No. 3,847,793 teach the use of riser reaction zone that converts a first feed and discharges the converted feed into a second bed type reaction zone that treats additional more refractory feed. All of the converted feeds are recovered from a common dilute phase collection zone in the reactor.

U.S. Pat. No. 2,956,003 and U.S. Pat. No. 2,921,014 teach an FCC process and the use of a riser type reaction vessel for the conversion of an FCC feed separation of converted feed and a separate dense bed reaction vessel for the conversion of the separated bottoms stream.

U.S. Pat. No. 3,607,129 shows an apparatus for cracking a heavy FCC feedstock in a riser conversion zone, discharging the cracked product into an FCC reactor vessel, cracking hydrotreated or unhydrotreated light cycle oil in a fluidized catalyst bed in a lower portion of the reaction vessel and withdrawing the cracked products from the riser and the dense bed through a common conduit.

U.S. Pat. No. 3,776,838 shows the cracking of a naphtha stream in a fluidized catalytic cracking process.

U.S. Pat. No. 5,154,818 shows the fluidized catalytic cracking of a first lighter feed fraction in an FCC riser with spent catalyst followed by cracking of full boiling range FCC feed in a downstream section of the riser.

U.S. Pat. No. 4,032,432 teaches the conversion of $C_6$ and lower boiling hydrocarbon cut in a secondary conversion zone of an FCC unit using spent catalyst to form aromatics or alkyl aromatics.

U.S. Pat. No. 5,372,704 discloses an FCC arrangement for recracking FCC naphtha. The process either cracks a heavy naphtha, defined as having a boiling point range of from 300 to 425° F. or a naphtha generally which would include a full range gasoline.

U.S. Pat. No. 5,176,815 discloses the use of an isolated reaction zone in an FCC stripper for converting a primary feed and a variety of segregated secondary feeds in an FCC reaction zone. U.S. Pat. No. 5,310,477 further uses the same arrangement for the specific contacting of a heavy gasoline cut from a primary FCC reaction.

BRIEF DESCRIPTION OF THE INVENTION

An object of this invention is the cracking of a heart cut of gasoline components at low severity condition with spent catalyst to obtain a surprising increase in gasoline octane number and an increase in the yield of $C_8$ aromatics with little or no dry gas production.

The invention, in contrast to the art that has further converted light gasoline stream comprising $C_6$ and lighter hydrocarbons for upgrading and heavy gasoline fractions to improve end point conditions, processes a gasoline stream in a narrow boiling point range of from 200 to 350° F. and more preferably in a boiling point range of from 250 to 350° F. It has surprisingly and unexpectedly been found that further conversion of this specific boiling range gasoline cut at mild processing conditions with spent catalyst will dramatically increase the octane of the resulting gasoline fraction. It was further found that allowing heavy hydrocarbons into the secondary conversion with the heart cut substantially negated the positive benefits of the further conversion on the gasoline properties and in particular undid the dramatic increase in octane number.

Accordingly, in one embodiment, this invention is a process for the fluidized catalytic cracking (FCC) of an FCC feedstock and the production of a high octane gasoline and $C_8$ aromatics. The process comprises passing the FCC feedstock and regenerated catalyst particles to a reactor riser and transporting the catalyst and feedstock through the riser thereby converting the feedstock to a riser gaseous product stream to produce partially spent catalyst particles by the deposition of coke on the regenerated catalyst particles. A discharge end of the riser directly discharges a mixture of partially spent catalyst particles and gaseous products into a separation zone that recovers the riser gaseous products from the riser in the separation zone. The process withdraws the recovered riser gaseous products from the separation zone through a first gas outlet and separates at least a portion of the secondary feed from the riser gaseous products into a secondary feed steam comprising a gasoline heart cut having at least 70 wt-% in a boiling point range of from 200 to 350° F. The secondary feed contacts the partially spent catalyst at a temperature of 950° F. or less, and a catalyst-to-oil ratio of not greater than 8 to produce a recontacted gasoline stream. After separation from the recontacted gasoline stream, the spent catalyst that contacted the secondary feed contacts a regeneration gas in the regeneration zone to combust coke from the catalyst particles and produce regenerated catalyst particles for transfer to the reactor riser. The recracked gasoline will usually contain a high concentration of $C_8$ aromatics that may equal 70 wt-% or more.

In a more specific embodiment, this invention is a process for the fluidized catalytic cracking (FCC) of an FCC feedstock and the production of an increased amount of $C_8$ aromatics that passes an FCC feedstock comprising hydrocarbons boiling above 650° F. and regenerated catalyst particles to a reactor riser and transporting the catalyst and feedstock through the riser thereby converting the feedstock to a riser gaseous product stream while producing partially spent catalyst particles by the deposition of coke on the regenerated catalyst particles. Discharging a mixture of partially spent catalyst particles and gaseous products from a discharge end of the riser directly into a separation zone contained in a reactor vessel permits recovery of the riser gaseous products from the riser in the separation zone. Withdrawing the recovered riser gaseous products from the separation zone through a first gas outlet and separation of at least a portion of the riser gaseous products into a gasoline heart cut produces a secondary feed comprising hydrocarbons having at least 80 wt-% in a boiling point range of from 250 to 350° F. The partially spent catalyst passes to a stripping zone located in a lower portion of the reactor vessel. Contacting of the secondary feed and partially spent catalyst in the stripping zone at a temperature of less than 900° F., and at a catalyst-to-oil ratio of not greater than about 6 produces a recontacted gasoline stream. The process separates spent catalyst from the recontacted gasoline stream and contacts the spent catalyst that contacted the secondary feed with a regeneration gas in the regeneration zone to combust coke from the catalyst particles and produce regenerated catalyst particles for transfer to said reactor riser.

In one respect, this invention demonstrates how an FCC unit may be operated to produce large quantities of $C_8$ aromatics. For example, in a typical 100,000 barrel per day (BPD) refinery, 37,000 barrels of this feed may go to an FCC unit. With an expected yield slate, the FCC unit would produce about 3300 BPD of a 250 to 350° F. gasoline cut containing about 800 BPD of $C_8$ aromatics. Recracking of this gasoline cut in accordance with this invention would raise the $C_8$ aromatic output from the FCC unit to about 2700 BPD. Recovery of these aromatic would increase the usual base load of $C_8$ aromatics from the reforming zone by about 50%. Thus, the operation of this invention may increase $C_8$ aromatics production by 50% in a typical refinery.

Furthermore, the process of this invention has been found to substantially increase the octane of FCC gasoline with very little yield penalty. Again, the process of this invention has been surprisingly found to only be effective on a particular boiling range of FCC gasoline and only at mild conditions. More specifically, the exposure of the FCC gasoline heart cut to very mild conditions, brought about by passing the heart cut over coked FCC catalyst at low reactor temperature can produce an increase in both the RON and MON of nearly 15 number in that heart cut. When blended back with the full range gasoline from the FCC unit the increase in octane number still typically ranges over 3 numbers and more typically over 3.5 numbers. Another unexpected benefit is the achievement of this octane gain with only about 1 wt-% loss of the original full boiling range gasoline.

Preferably, the riser discharges catalyst and vapor into a separation device at the end of a riser which separates catalyst from gas that exits the end of the riser and effects a very low transfer of riser vapors into a reactor vessel. In this way, a dense bed of catalyst in the reactor vessel can act as an independent conversion zone for the specific gasoline cut of this invention. Thus, the arrangement allows vapors from the riser reaction zone to remain isolated from the reactor vessel vapors until after an essentially complete separation of the riser vapors from the catalyst.

The riser and enclosed separation system can also provide a short contact time and limited catalyst-to-hydrocarbon ratios for reactants passing therethrough and a relatively long catalyst contact time and a high catalyst-to-hydrocarbon ratio for the secondary feed. Thus, the short contact time riser conditions favor highly reactive monomolecular reactions whereas, the longer contact times with the partially deactivated catalyst in the reactor vessel favor certain bimolecular reactions. Thus, this invention may be applied with independent control of two separate reaction zones within one FCC reactor to convert a gasoline heart cut to higher octane products.

Other objects, embodiments, and details of this invention are set forth in the following detailed description of the invention.

BRIEF DESCRIPTION OF THE DRAWINGS

The FIGURE is a schematic diagram of the process of this invention showing an FCC unit, a main separation zone, and an optional separation zone.

DETAILED DESCRIPTION OF THE INVENTION

This invention relates generally to the reactor side of the FCC process. This invention will be useful for most FCC processes that are used to crack light or heavy FCC feedstocks. The process of this invention can be used to modify the operation and arrangement of existing FCC units or in the design of newly constructed FCC units.

This invention uses the same general elements of many FCC units. A reactor riser provides the primary reaction zone. A reactor vessel with a catalyst separation device removes catalyst particles from the gaseous product vapors. A stripping zone removes residual adsorbed hydrocarbons from the catalyst. Spent catalyst from the stripping zone is regenerated in a regeneration zone having one or more stages of regeneration. Regenerated catalyst from the regeneration zone re-enters the reactor riser to continue the process. A number of different arrangements can be used for the elements of the reactor and regenerator sections. The description herein of specific reactor and regenerator components is not meant to limit this invention to those details except as specifically set forth in the claims.

An overview of the basic process operation can be best understood with reference to the FIGURE. Regenerated catalyst from a catalyst regenerator 10 (shown schematically) is transferred by a conduit 12, to a Y-section 14. Lift gas injected into the bottom of Y-section 14, by a conduit 16, carries the catalyst upward through a lower riser section 18. Traditional FCC feed is injected into the riser above lower riser section 18 at feed injection points 20.

The mixture of feed, catalyst and lift gas travels up an intermediate section 22 of the riser and into an upper internal riser section 24 that terminates in an upwardly directed outlet end 26. Riser end 26 is located in a separation device 28 which in turn is located in a reactor vessel 30. The separation device removes a majority of the catalyst from the cracked hydrocarbon vapors that exit riser end 26. Catalyst removed by separation device 28 falls into dense catalyst bed 52. Cyclone 42 receives the cracked vapors from the separation device and removes essentially all of the remaining catalyst from the riser vapor stream. Separated catalyst from cyclone 42 drops downward into the reactor through dip legs 50 into a catalyst bed 52. Conduit 44 withdraws the riser vapors from the top of the cyclone 42 and transfers the vapors as gaseous products to a separation zone comprising a main column 45.

Main column 45 usually fractionates the feed into multiple fractions. The depicted streams include, a gas stream taken by line 46, a light gasoline cut taken by line 47, a gasoline heart cut taken by a line 79, a heavy gasoline cut taken by a line 49, and a cycle oil portion taken by a line 51 that comprises light cycle oil and heavier hydrocarbons and which preferably leaves the column in at least two cuts comprising a light cycle oil and heavy cycle oil. A line 53 withdraws heavier hydrocarbon from the bottom of the main column which are typically recycled in part as feed to riser 22.

Line 79 feeds at least a portion of the gasoline heart cut to the dense bed 52 via a distributor 57 to provide at least a portion of the secondary feed. Where desired, the gasoline may undergo further processing, such as hydrotreatment in a treatment zone (not shown), before entering bed 52. Additional gasoline components may also be blended with the contents of line 79 or directly charged to bed 52 for further conversion with the gasoline products recovered from main column 45.

Reactor vessel 30 has an open volume above catalyst bed 52 that provides a dilute phase section 74. The dense bed 52 provides the spent catalyst that promotes the mild contacting conditions for the gasoline feed.

As the secondary feed enters reactor 30, distributor 57 disburses the feed over a portion of the bottom of bed 52. Suitable distributors may disperse the feed over only a portion of the dense bed or stripper as shown in the FIGURE or alternately the distributor may distribute catalyst over the entire cross section of the stripper or dense bed. Partitioning of the stripping vessel or dense bed permits further control of the catalyst-to-oil ratio for the contacting of the secondary feed.

The limited secondary feed dispersal of distributor 57 works in conjunction with a baffle arrangement that partitions a portion of stripper vessel to segregate the catalyst that is contacted by the secondary feed. A baffle 59 extends radially outward from the riser 24 and a similar baffle (not shown) extends outwardly from an opposite side of the riser. Together both baffles segregate a sector of the stripper to limit the amount of catalyst that contacts the secondary feed. Distributor 57 extends circumferentially over the area of the sector. The spacing between the baffles may subtend any desired angle to segregate a suitable volume of the stripper. The top of the baffle will normally end below the top of the dense catalyst bed to permit some circulation of the catalyst as it initially enters the bed 52. The bottom of the baffle will usually not extend to the bottom of the stripper to facilitate catalyst withdrawal.

Catalyst cascades downward from bed 52 through a series of baffles 60 that project transversely across the cross-section of a stripping zone 63 in stripper vessel 62. Preferably, stripping zone 63 communicates directly with the bottom of reactor vessel 30 and more preferably has a sub-adjacent location relative thereto. As the catalyst falls, steam or another stripping medium from a distributor 64 rises countercurrently and contacts the catalyst to increase the stripping of adsorbed components from the surface of the catalyst. A conduit 66 conducts stripped catalyst into catalyst regenerator 10 which combustively removes coke from the surface of the catalyst to provide regenerated catalyst.

The countercurrently rising stripping medium desorbs hydrocarbons and other sorbed components from the catalyst surface and pore volume. Stripped hydrocarbons and stripping medium rise through bed 52 and combine with the secondary feed and any resulting products in the dilute phase section 74 of reactor vessel 30 to form a reactor vessel product stream.

At the top of dilute phase section 74, an outlet withdraws the stripping medium and stripped hydrocarbons from the reactor vessel. One method of withdrawing the stripping medium and hydrocarbons is shown in the FIGURE as cyclone 75 which separates catalyst from the reactor vessel product stream. A line 77 withdraws the reactor vessel product stream from the cyclone and out of reactor vessel 30. The reactor vessel product can pass via line 77 to the main column, but the FIGURE shows an alternate route for the reactor vessel product to a separate separation column 83. When present, separation column 83 typically separates light gases, via a line 89 from the upgraded gasoline. Line 55 recovers the upgraded gasoline and typically recombines the upgraded gasoline with one or both of the light gasoline stream and, as shown in the FIGURE, the heavy gasoline fraction.

This invention can employ a wide range of commonly used FCC catalysts. These catalyst compositions include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more.

Particularly preferred zeolites include high silica to alumina compositions such as LZ-210 and similar type materials. Another particularly useful type of FCC catalysts comprises silicon-substituted aluminas. As disclosed in U.S. Pat. No. 5,080,778, the zeolite or silicon enhanced alumina catalysts compositions may include intercalated clays, also generally known as pillared clays.

Feeds suitable for processing by this invention include conventional FCC feedstocks or higher boiling hydrocarbon feeds. A customary FCC feedstock will comprise hydrocarbons with less than 10 wt-% having a boiling point below 650° F.

The most common of the conventional feedstocks is a vacuum gas oil which is typically a hydrocarbon material having a boiling range of from 650–1025° F. and is prepared by vacuum fractionation of atmospheric residue. Such fractions are generally low in coke precursors and heavy metals which can deactivate the catalyst.

The invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron, and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

The FCC feed and regenerated catalyst enter a contacting conduit. When transporting catalyst and oil upwardly, the contacting conduit has usually been termed a "riser". Although not new to the art, there has been increased recent discussion of the downward transport of catalyst and oil through the contacting conduit and of arrangement for ultra short contact time. For convenience, the contacting conduit is termed a "riser" throughout this discussion, however, the term "riser" is not meant to preclude practice of this invention with contacting conduits that transport the catalyst and oil mixture in directions other than vertical or the use of arrangements for ultra short catalyst contact time.

The reactor riser shown in the FIGURE discharges the mixture of catalyst and feed into a device that performs an initial separation between the catalyst and gaseous components in the riser. The term "gaseous components" includes lift gas, product gases and vapors, and unconverted feed components. The FIGURE shows this invention being used with a riser arrangement having a lift gas zone 18. A lift gas zone is not a necessity to enjoy the benefits of this invention. The end of the riser may terminate with one or more upwardly directed openings that discharge the catalyst and gaseous mixture in an upward direction into a dilute phase section of a disengaging vessel. The open end of the riser can be of an ordinary vented riser design as described in the prior art patents of this application or of any other configuration that provides a substantial separation of catalyst from gaseous material in the dilute phase section of the reactor vessel.

The flow regime within the riser will influence the separation at the end of the riser. Typically, the catalyst circulation rate through the riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture. The length of the riser will usually be set to provide a residence time of between 0.5 to 10 seconds at these average flow velocity conditions. Other reaction conditions in the riser usually include a temperature of from 875–1050° F.

Gas oil or residual feed contacting in the riser usually takes place under the typical short contact time conditions. Maintaining short contact times requires a quick separation of catalyst and hydrocarbons at the end of the riser. It is important to this invention that a separation device at the end of the riser provide a quick separation of the catalyst from the riser vapors and also limit the transfer of vapors from the riser into the dilute phase zone of the reactor vessel. Preferred separation devices for the end of the riser will provide a low catalyst residence time and recover at least 90 wt-% of the vapors discharged from the riser. Preferably, the separation device at the end of the riser will recover 95 wt-% of the vapors that the riser discharges without carryover losses into the dilute phase section 74. Preferably, the products from the reactor vessel reaction zone are recovered with minimal intermixing of the riser product stream. Therefore, a separate outlet can be provided for the recontacted gasoline that has been upgraded in the secondary zone and that outlet withdraws a stream of at least 90 wt-% recontacted gasoline and less than 10 wt-% of the riser gaseous products. U.S. Pat. No. 5,310,477, the contents of which are hereby incorporated by reference, discloses a riser separation arrangement that can provide a recovery of over 95 wt-% recovery of riser product components and a preferred manner of displacing riser gaseous components from the catalyst leaving the riser by passing a displacement fluid through the catalyst discharged from the riser.

The secondary feed may contact the spent catalyst in any type of contacting zone that will provide sufficient contact time and the desired low severity conditions. It is contemplated that a separation device will supply the catalyst for contacting the secondary feed. The separation device will ordinarily have a location in an upper portion of the reactor vessel. As shown in the FIGURE, catalyst from the such a separation device may drop downwardly into the dense bed 52 that is maintained in a lower portion of reactor vessel 30 and referred to as the reactor vessel reaction zone. Catalyst collecting in bed 52, although containing a relatively high coke concentration, still has sufficient surface area for catalytic use. Typically, the coke concentration of the catalyst in this bed will range from 0.5 to 1.5 wt-%. Additional stripping may remove more hydrocarbon compounds from the secondary reaction zone, however, the benefits of more complete stripping come at the expense of additional dilute phase volume in a fixed bed reaction zone and generally the superficial velocity of the gases rising through bed 50 should stay below 0.5 ft/sec and preferably below about 0.1 ft/sec.

Bed 52 supplies a high inventory of catalyst that is available for contact with the secondary feed. Feed can enter such dense bed at any point below the upper surface of the dense bed. Where a subadjacent stripping zone receives catalyst passing through the reactor vessel, the secondary feed may be injected into the stripping zone at any location including the bottom, provided the injection point is above the lowermost point of steam injection.

It is essential to this invention that regardless of the contacting zone, the secondary feed have a particular boiling range composition. The secondary feed includes a portion of a gasoline heart cut from the riser gaseous products that has at least 70 wt-% of its hydrocarbons boiling in a range of from 200 to 350° F. Preferably, the secondary feed comprises a gasoline heart cut having at least 80 wt-% in a boiling point range of from 250 to 350° F. In most cases, more than 90 wt-% of the secondary feed stream will boil above about 250° F. and preferably 90 wt-% of the secondary feed is in a boiling range of from 250 to 350° F. The main column or other fluid separation zone generally separates the gaseous product stream from the riser into a first product stream comprising light gasoline having an end boiling point at least below 250° F.; a gasoline heart cut having an 80 wt-% boiling point of at least 200° F. and an end point below about 400° F.; a heavy gasoline having an initial boiling point greater than 350° F. and an end boiling point of at least 400° F., and a first cycle oil stream and heavier fractions having an initial boiling point above the end point of the gasoline feed. The gasoline heart cut will typically have an 85 wt-% boiling point of about 350° F. and preferably a 90 wt-% boiling point of 350° F. More preferably, 95 wt-% of the secondary feed and the gasoline heart cut will boil below about 350° F. The volume of the gasoline heart cut relative to the entire gasoline cut usually amounts to less than 50 wt-%. For many cases, the secondary feed will comprise 20 to 30 wt-% of the gasoline stream recovered from the gaseous products and will have at least 80 wt-% boiling in a range of from 250 to 370° F.

At its minimum end point, the heart cut will be at about the boiling point of $C_9$ aromatics, in particular 1,2,4-trimethylbenzene. A lower cut point temperature between the heart cut and the heavy gasoline, down to about 320° F., will push additional $C_9$ aromatics into the heavy gasoline stream. The upper end of the heavy gasoline cut is selected to retain $C_{12}$ aromatics. The lower end of the heavy gasoline cut will retain at least some $C_{10}$ aromatics. Retaining $C_{10}$ to $C_{12}$ aromatics in the heavy gasoline fraction avoids loss of these components since they are readily dealkylated. The higher end points for the gasoline heart cut still keeps most bicyclic compounds out of the secondary reaction zone. These bicyclic compounds include indenes, tetralins, biphenyls and naphthalenes which are refractory to cracking under the conditions in the reactor vessel reaction zone and in the absence of pretreatment, bring little benefit, and is in fact have been found to diminish the effectiveness of the gasoline recontacting step.

Aside from the composition of the secondary feed, conditions within the secondary reaction zone are relatively mild. It was already explained that the secondary feed contacts partially spent catalyst, optionally in the stripping zone. The contacting will take place at an average catalyst and feed temperature of less than 950° F., preferably less than 900° F. and more typically a temperature in a range of from of from 830 to 900° F. It may also be beneficial to limit the catalyst-to-oil ratio in the secondary contacting zone to not more than about 8 and more preferably about 6 or less. The contacting routinely occurs at a weight hourly space velocity (WHSV) of not greater than 2 and, more routinely, of not greater than 1.5. However, higher WHSV's may provide equivalent results. The catalyst-to-oil ratio and the WHSV may be controlled by the use of suitable partitioning in the secondary zone when it is necessary to contact the secondary feed with less than all of the circulating spent catalyst.

As mentioned previously, a single main column separation zone can receive both product streams and separate the combined product stream into the aforementioned gasoline fractions along with any additional product cuts such as the cycle oil and heavier fractions. Separating all of the products in a single separation zone has the advantage of reducing equipment and maximizing the recontacting of gasoline components. A single separation zone has the disadvantage of allowing the build-up of certain refractory compounds in the recycle loop. Thus, a single separation zone may require appropriate facilities to remove refractory components, such as the taking of a drag stream. However, the selection of a heart cut gasoline fraction minimizes the build-up of refractory compounds. Therefore, the single separation zone arrangement is most suited for operations that recontact the more narrow gasoline cuts. A distinct separation zone for the secondary reaction zone may be most suitable for revamps where the main column could not accept the additional throughput.

EXAMPLES 1 and 2

The following examples show that a secondary reaction zone operating with spent catalyst from a riser type reaction zone can effect significant octane upgrading when limited to processing a heart cut gasoline fraction. In this example, a sample of a GXO-28 low metals equilibrium catalyst (manufactured by Grace-Davison) containing an average of about 0.8 wt-% coke was used to simulate the recracking of a gasoline feed boiling in a range of from 250 to 350° F. The feed had the properties listed in Table 1. The coked catalyst contacted the feed in a fixed bed reaction zone at a WHSV of 1.0, a catalyst-to-oil ratio of 6.0 and a temperature of 850° F. Product streams having the compositions given in Table 2 were recovered from the reaction zone for Examples 2 and 3 as indicated.

TABLE 1

| | |
|---|---|
| IBP | 268° F. |
| 90% BP | 350° F. |
| EP | 372° F. |
| RON | 94.0 |
| MON | 83.0 |
| PARAFFINS & NAPHTHENES | 25 LV % |
| OLEFINS | 14 LV % |
| AROMATICS | 61 LV % |

TABLE 2

| | Example | |
|---|---|---|
| PRODUCT STREAM (wt %) | #1 | #2 |
| $H_2S$ | .00 | .00 |
| $NH_3$ | .01 | .00 |
| $H_2$ | .01 | .01 |
| $(C_1 + C_2)$ | .22 | .23 |
| $C_3$ | .13 | .13 |
| $C_3$ = | .23 | .23 |
| $C_4$ | .39 | .45 |
| $C_4$ = | .28 | .28 |
| $C_5$–268° F. | 7.54 | 7.17 |
| 268–350° F. | 86.76 | 86.10 |
| 350–450° F. | 1.04 | .85 |
| 450–650° F. | 2.09 | 1.70 |

TABLE 2-continued

| PRODUCT STREAM (wt %) | Example #1 | Example #2 |
|---|---|---|
| 650+ | 1.31 | 2.05 |
| COKE | 0.0 | 7.9 |
| CONVERSION | 13.24 | 13.90 |
| RONC | 106 | 107 |
| MONC | 96 | 97 |
| PARAFFINS & NAPHTHENES (LV %) | 8.5 | 8.0 |
| OLEFINS (LV %) | 0.0 | 0.0 |
| AROMATICS (LV %) | 91.5 | 92.0 |

Table 2 demonstrates that contact of the feed with the coked catalyst provided a substantial conversion of the gasoline heart cut to aromatic gasoline components. As can be seen from the tables, over 7 wt-% of the converted material goes to light gasoline ($C_5$ to 258° F). Less than 1.4 wt-% goes to dry gas and LPG. No more than 4.5 wt-% goes to heavier products. Thus, recracking the 258 to 350° F. material almost completely removed the olefins and significantly reduced the P+N fraction. In addition, the octane of the $C_5$ to 350° F. fraction was significantly increased as can be seen in Table 2. The degree of hydrocarbon rearrangement is surprising considering the small amount of conversion (about 13 wt-%) that occurred. Furthermore, the amount of full range gasoline ($C_5$ to 450° F.) recovered after return of the recracked fraction is about 95 wt-% of the starting 258 to 350° F. gasoline. Most of the aromatic product can be accounted for as $C_8$ aromatics. The feed contained about 24 wt-% $C_8$ aromatics and 29 wt-% $C_9$ aromatics. The liquid product contained over 85 wt-% $C_8$ aromatics on a fresh feed basis, out of a total of 89 wt-% total aromatics. Although not wishing to be bound by any theory, the data suggests that $C_8$ aromatic compounds are formed by the cyclization of olefins and the loss of a methyl group from the $C_9$ aromatics. Moreover, the $C_{10}$ aromatics are also decreased, apparently going to $C_8$ aromatics and most of the tetralins appear to have cracked to a lower ring structure with a portion dehydrogenating to multi-ring aromatics compounds that undergo alkylation.

EXAMPLES 3 and 4

The conversion of other higher boiling feed fractions at the same conditions as Examples 1 and 2 were studied, but produced distinctly poorer results. Examples 3 and 4 use the whole FCC gasoline cut, which combines the 268 to 350° F. fraction with the 350° F. to EP fraction and is further described in Table 3. Recontacting of the entire fraction resulted in a much higher conversion, about 19 wt-%, of the 268 to 350° F. fraction than was seen when the 268 to 350° F. fraction was processed alone as shown in Table 4. The result of blending the converted gasoline product of Example 3 and 4 back with the starting $C_5$ to 258° F. to produce a full range gasoline is an octane increase of 1.6 numbers, with a loss in full range gasoline yield of about 5 wt-%. This compares with the 3.5 number octane gain at only a 1 wt-% loss when only processing the 268 to 350° F. fraction of Examples 1 and 2.

TABLE 3

| | |
|---|---|
| IBP | 268° F. |
| 90% BP | 406° F. |
| EP | 604° F. |

TABLE 3-continued

| | |
|---|---|
| RON | 92.0 |
| MON | 80.0 |
| PARAFFINS & NAPHTHENES | 38 LV % |
| OLEFINS | 33 LV % |
| AROMATICS | 29 LV % |

TABLE 4

| PRODUCT STREAM (wt %) | Example #3 | Example #4 |
|---|---|---|
| RON | 96.0 | 95.8 |
| PARAFFINS & NAPHTHENES | 28.5 | 27.1 |
| OLEFINS | Trace | 0.6 |
| AROMATICS | 71.5 | 72.3 |

The foregoing description sets forth essential features of this invention which can be adapted to a variety of applications and arrangements without departing from the scope and spirit of the claims hereafter presented.

What is claimed is:

1. A process for the fluidized catalytic cracking (FCC) of an FCC feedstock and the production of a $C_8$ aromatics, the process comprising:

a) passing the FCC feedstock and regenerated catalyst particles to a reactor riser and transporting the catalyst and feedstock through the riser thereby converting the feedstock to a riser gaseous product stream and producing partially spent catalyst particles by the deposition of coke on the regenerated catalyst particles;

b) discharging a mixture of partially spent catalyst particles and gaseous products from a discharge end of the riser directly into a separation zone and recovering the riser gaseous products from the riser in the separation zone;

c) withdrawing the recovered riser gaseous products from the separation zone through a first gas outlet;

d) separating at least a portion of the riser gaseous products into a secondary feed comprising a gasoline heart cut having at least 70 wt-% in a boiling point range of from 200 to 350° F.;

e) contacting the secondary feed and partially spent catalyst at a temperature of less than 950° F., and at a catalyst-to-oil ratio of not greater than 8 to produce a recontacted gasoline stream; and, f) separating spent catalyst from the recontacted gasoline stream and contacting the spent catalyst that contacted the secondary feed with a regeneration gas in a regeneration zone to combust coke from the catalyst particles and produce regenerated catalyst particles for transfer to said reactor riser.

2. The process of claim 1 wherein at least 90 wt-% of the gaseous products are recovered from the partially spent catalyst particles in the separation zone.

3. The process of claim 1 wherein a fluid separation zone separates the gaseous product stream into a first product stream comprising light gasoline having an end boiling point below 250° F.; a secondary feed having an initial boiling point of at least 200° F. and an end point not greater than 350° F; a heavy gasoline having an initial boiling point equal to or greater than 350° F. and an end boiling point of at least 400° F., and a first cycle oil stream having an initial boiling point above the end point of the heavy gasoline.

4. The process of claim 3 wherein heavy gasoline feed is blended with the recontacted gasoline stream to produce an upgraded gasoline having a motor or research octane at least 3 numbers higher than the corresponding motor or research octane number of the secondary feed and heavy gasoline.

5. The process of claim 3 wherein the recontacted gasoline stream contains at least 70 wt-% $C_8$ aromatics.

6. The process of claim 1 wherein not more than 10 wt-% of the reactor riser gaseous products enter a secondary contacting zone where the secondary feed contacts the partially spent catalyst.

7. The process of claim 1 wherein gaseous products enter a secondary contacting zone where the secondary feed contacts the partially spent catalyst and the secondary contacting zone comprises a dense bed of catalyst contained in a reaction vessel.

8. The process of claim 7 wherein a second outlet withdraws at least 90 wt-% of the recontacted gasoline stream and less than 10 wt-% of the riser gaseous products through a second outlet.

9. The process of claim 1 wherein a stripping zone is located in a lower part of a reactor vessel, catalyst passes from the reactor vessel to the stripping zone, a stripping fluid passes upwardly through the stripping zone, contacting between the secondary feed and the partially spent catalyst takes place in the stripping zone; and spent catalyst passes from the stripping zone to the regeneration zone.

10. The process of claim 9 wherein the secondary feed is injected into the bottom of the stripping zone.

11. The process of claim 1 wherein the separation zone comprises a disengaging zone, the reactor riser extends into the separation zone, and the partially spent catalyst and the riser gaseous products are discharged directly into the disengaging zone.

12. The process of claim 11 wherein the disengaging zone is located in a reactor vessel.

13. The process of claim 12 wherein a dense bed of the partially spent catalyst is maintained in the disengaging zone and a stripping medium passes upwardly through the dense bed of catalyst in the disengaging zone and is withdrawn with the riser gaseous products.

14. The process of claim 13 wherein the separation zone includes a riser disengaging zone, the riser has an open discharge end that upwardly discharges the spent catalyst and the riser gaseous products into the disengaging vessel, riser gaseous products and catalyst are transferred from the disengaging vessel to a cyclone separator, the riser gaseous products are withdrawn from the cyclone separator through the first outlet, and partially spent catalyst from the cyclone separator is discharged into the reactor vessel.

15. The process of claim 1 wherein the gaseous product stream enters a first separation zone and the recontacted gasoline stream enters a second separation zone.

16. The process of claim 1 wherein less than 15 wt-% of the secondary feed stream boils above about 350° F.

17. The process of claim 1 wherein less than 10 wt-% of the secondary feed stream boils above about 350° F.

18. The process of claim 1 wherein more than 80 wt-% of the secondary feed stream boils above about 200° F.

19. The process of claim 1 wherein more than 90 wt-% of the secondary feed stream boils above about 250° F.

20. The process of claim 1 wherein the secondary feed and partially spent catalyst are contacted at a WHSV not greater than 2.

21. A process for the fluidized catalytic cracking (FCC) of an FCC feedstock and the production of a high octane gasoline, said process comprising:

a) passing an FCC feedstock comprising hydrocarbons boiling above 650° F. and regenerated catalyst particles to a reactor riser and transporting the catalyst and feedstock through the riser thereby converting the feedstock to a riser gaseous product stream and producing partially spent catalyst particles by the deposition of coke on the regenerated catalyst particles;

b) discharging a mixture of partially spent catalyst particles and gaseous products from a discharge end of the riser directly into a separation zone contained in a reactor vessel and recovering the riser gaseous products from the riser in the separation zone;

c) withdrawing the recovered riser gaseous products from the separation zone through a first gas outlet;

d) separating at least a portion of the riser gaseous products into a secondary feed comprising a gasoline heart cut having at least 80 wt-% in a boiling point range of from 268 to 350° F.;

e) passing the partially spent catalyst to stripping zone located in a lower portion of the reactor vessel;

f) contacting the secondary feed and partially spent catalyst in the stripping zone at a temperature of less than 900° F., and at a catalyst-to-oil ratio of not greater than about 6 to produce a recontacted gasoline stream; and, g) separating spent catalyst from the recontacted gasoline stream and contacting the spent catalyst that contacted the secondary feed with a regeneration gas in a regeneration zone to combust coke from the catalyst particles and produce regenerated catalyst particles for transfer to said reactor riser.

22. The process of claim 21 wherein the secondary feed from the riser gaseous products comprises a gasoline heart cut having at least 90 wt-% in a boiling point range of from 250 to 350° F.

23. The process of claim 21 wherein the partially spent catalyst has a coke concentration in a range of from 0.5 to 1.5 wt-%.

24. The process of claim 21 wherein the partially spent catalyst and secondary feed have an average temperature of from 830 to 900° F.

25. The process of claim 21 wherein the secondary feed comprises 20 to 30 wt-% of a gasoline stream recovered from the gaseous products and having at least 90 wt-% boiling in a range of from 250 to 350° F.

26. The process of claim 21 wherein the secondary feed and partially spent catalyst are contacted at a WHSV not greater than 1.5.

* * * * *